US012338032B2

(12) United States Patent
Bi

(10) Patent No.: US 12,338,032 B2
(45) Date of Patent: Jun. 24, 2025

(54) CONTAINER HOLDER

(71) Applicant: Wentao Bi, Rongcheng (CN)

(72) Inventor: Wentao Bi, Rongcheng (CN)

( * ) Notice: Subject to any disclaimer, the term of this patent is extended or adjusted under 35 U.S.C. 154(b) by 0 days.

(21) Appl. No.: 18/915,827

(22) Filed: Oct. 15, 2024

(65) Prior Publication Data

US 2025/0033833 A1 Jan. 30, 2025

(30) Foreign Application Priority Data

Sep. 30, 2024 (CN) ..... 202422414669.7

(51) Int. Cl.
*A47G 23/02* (2006.01)
*B65D 25/24* (2006.01)

(52) U.S. Cl.
CPC ..... *B65D 25/24* (2013.01); *A47G 23/0216* (2013.01)

(58) Field of Classification Search
CPC .... B65D 25/24; A47G 23/0216; A47G 23/02; A47G 2400/086
USPC ..... 220/737
See application file for complete search history.

(56) References Cited

U.S. PATENT DOCUMENTS 6,315,153 B1 * 11/2001 Osborn ..... A47G 23/0216 220/737

* cited by examiner

*Primary Examiner* — Don M Anderson
*Assistant Examiner* — Elizabeth J Volz
(74) *Attorney, Agent, or Firm* — Addison D. Ault; IPGentleman Intellectual Property Services, LLC

(57) ABSTRACT

The present disclosure provides a container holder, which comprises a base with a container bottom contact surface and a sidewall extending upward from the edge of the container bottom contact surface; the sidewall and the container bottom contact surface jointly enclose an accommodating space for accommodating a container; the base further comprises an extension part extending outward from the edge of the container bottom contact surface; the container bottom contact surface is provided with a through groove, and the container holder is provided with a base opening extending from the edge of the extension part to the sidewall in a curved manner, and the base opening is communicated with the through groove. With the base opening communicated with the through groove, the container holder can be fixed on the plane where the container holder is placed by a rope, and the position of the container holder can be adjusted along the rope.

11 Claims, 4 Drawing Sheets

CONTAINER HOLDER

CROSS-REFERENCE TO RELATED APPLICATIONS

The present application claims priority to Chinese Patent Application No. 202422414669.7, filed on Sep. 30, 2024, the content of which is incorporated herein by reference in its entirety.

TECHNICAL FIELD

The present disclosure relates to the technical field of fixing fittings, in particular to a container holder.

BACKGROUND

People usually drink beverages from beverage containers. When people do not drink beverages, the beverage containers still filled with drinks are often placed on a flat surface, waiting for people to drink next time. Unfortunately, the physical size of the drinking container often causes it to be pushed unintentionally, and it will fall or the beverage will overflow due to overturning. In order to avoid this situation, a beverage container holder applicable for fixing beverage containers has been designed.

Beverage container holders are particularly important for users who need to drink beverages when the users are located on moving objects, such as vehicles or water sports equipment. However, the common beverage container holders are either immobile, which makes it inconvenient for users to adjust their positions as needed, or the installation method is cumbersome.

SUMMARY

In view of the above, there is a need to propose a container holder with simple installation mode and convenient position adjustment.

The present disclosure provides a container holder, which includes a base with a container bottom contact surface and a sidewall extending upward from an edge of the container bottom contact surface, wherein the sidewall and the container bottom contact surface jointly enclose an accommodating space for accommodating a container, wherein the base further includes an extension part extending outward from the edge of the container bottom contact surface; the container bottom contact surface is provided with a through groove, the container holder is provided with a base opening extending from an edge of the extension part to the sidewall in a curved manner, and the base opening is communicated with the through groove.

Preferably, a highest point of the base opening is higher than the container bottom contact surface.

Preferably, the base further includes a support part straddling below the through groove.

Preferably, the support part is provided with a through hole.

Preferably, the sidewall includes a lower sidewall connected with the base and an upper sidewall extending upward from the lower sidewall, and a diameter of an annulus enclosed by the upper sidewall is larger than that of an annulus enclosed by the lower sidewall.

The container holder provided by the present disclosure includes a base with a container bottom contact surface and a sidewall extending upward from the edge of the container bottom contact surface; the sidewall and the container bottom contact surface jointly enclose an accommodating space for accommodating a container; the base further includes an extension part extending outward from the edge of the container bottom contact surface; the container bottom contact surface is provided with a through groove, and the container holder is provided with a base opening extending from the edge of the extension part to the sidewall in a curved manner, and the base opening is communicated with the through groove. With the base opening communicated with the through groove, the container holder can be fixed on the plane where the container holder is placed by a rope, and the position of the container holder can be adjusted along the rope.

The present disclosure further provides a container holder, which includes a base with a container bottom contact surface and a sidewall extending upward from an edge of the container bottom contact surface, wherein the sidewall and the container bottom contact surface jointly enclose an accommodating space for accommodating a container; wherein the base further includes an extension part extending outward from the edge of the container bottom contact surface; the container bottom contact surface is provided with a through groove, the container holder is provided with a sidewall opening extending from an outer surface of the sidewall to the container bottom contact surface in a curved manner, and the sidewall opening is communicated with the through groove.

Preferably, the sidewall includes a lower sidewall connected with the base and an upper sidewall extending upward from the lower sidewall, and a diameter of an annulus enclosed by the upper sidewall is larger than that of an annulus enclosed by the lower sidewall.

Preferably, the sidewall opening includes an upper sidewall opening arranged on the upper sidewall, and the upper sidewall opening penetrates through the lower sidewall and is communicated with the through groove.

Preferably, the sidewall opening includes a lower sidewall opening arranged on the lower sidewall, and a highest point of the lower sidewall opening is higher than the container bottom contact surface.

Preferably, the base further includes a support part straddling below the through groove.

Preferably, the support part is provided with a through hole.

The container holder provided by the present disclosure includes a base with a container bottom contact surface and a sidewall extending upward from the edge of the container bottom contact surface; the sidewall and the container bottom contact surface jointly enclose an accommodating space for accommodating a container; the base further includes an extension part extending outward from the edge of the container bottom contact surface; the container bottom contact surface is provided with a through groove, the container holder is provided with a sidewall opening extending from the outer surface of the sidewall to the container bottom contact surface in a curved manner, and the sidewall opening is communicated with the through groove. With the sidewall opening communicated with the through groove, the container holder can be fixed on the plane where the container holder is placed by a rope, and the position of the container holder can be adjusted along the rope.

BRIEF DESCRIPTION OF DRAWINGS

In order to explain the specific embodiment of the present disclosure or the technical solution in the prior art more clearly, the drawings needed in the description of the specific embodiment or the prior art will be briefly introduced below. Obviously, the drawings in the following description are some embodiments of the present disclosure. For those skilled in the art, other drawings can be obtained according to these drawings without creative work.

DESCRIPTION OF EMBODIMENTS

The technical solution of the present disclosure will be described clearly and completely with the attached drawings. Obviously, the described embodiment is part of the embodiments of the present disclosure, but not all of embodiments. Based on the embodiment of the present disclosure, all other embodiments obtained by ordinary technicians in the field without creative labor shall fall into the protection scope of the present disclosure.

In the description of this utility model, it should be noted that if the terms "center", "upper", "lower", "left", "right", "vertical", "horizontal", "inside" and "outside" appear, the indicated orientation or position relationship is based on the orientation or position relationship shown in the attached drawings, which is only for the convenience of describing this utility model and simplifying the description. In addition, the terms "first", "second" and "third" are used for descriptive purposes only, and cannot be construed as indicating or implying relative importance.

Figure 1:
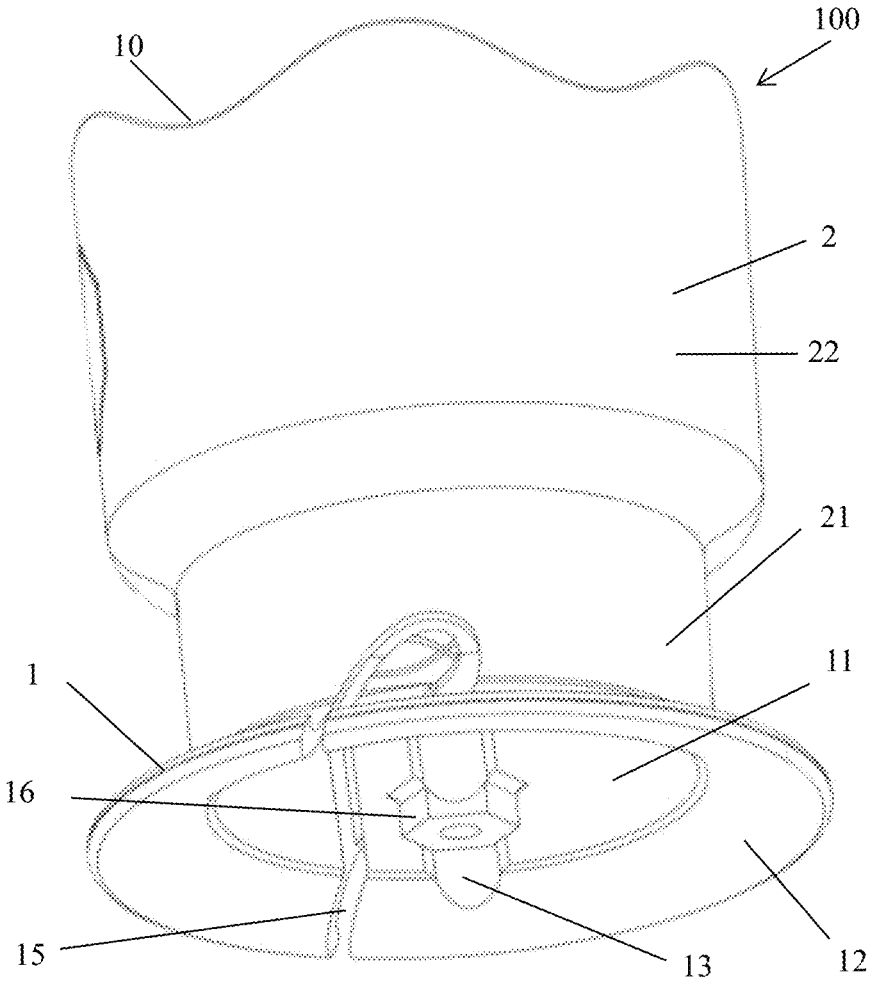
FIG. 1 is an assembled schematic view of a container holder provided by one embodiment.
Figure 2:
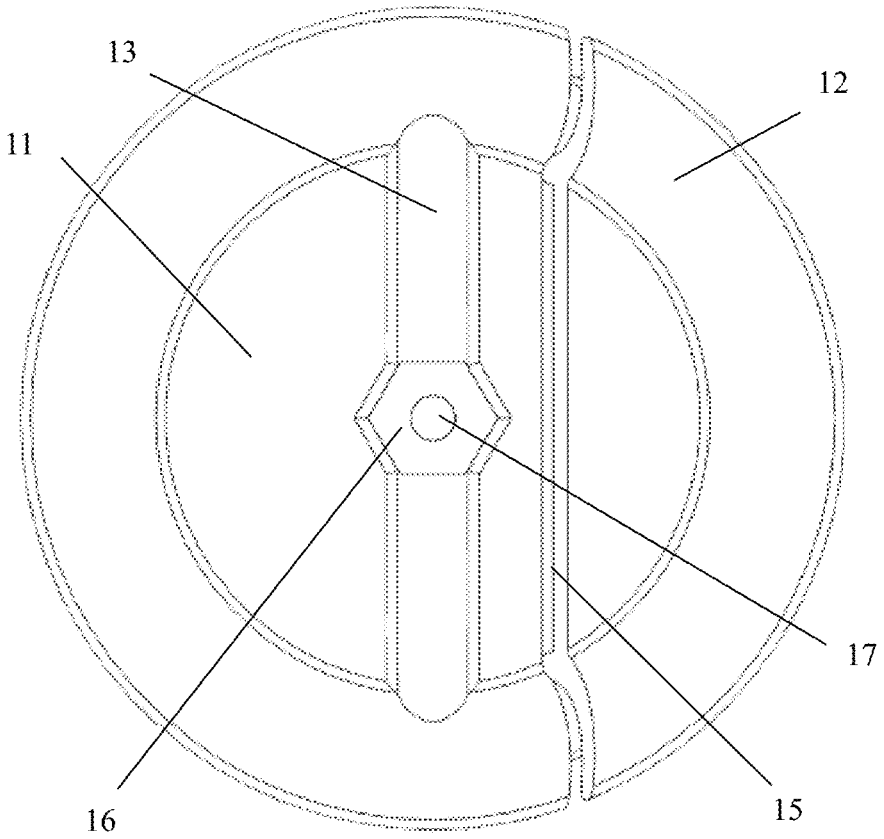
FIG. 2 is a bottom view of the container holder shown in FIG. 1.

As shown in FIG. 1 and FIG. 2, the container holder 100 provided by this utility model includes a base 1 with a container bottom contact surface 11 and a sidewall 2 extending upward from the edge of the container bottom contact surface 11. The sidewall 2 and the container bottom contact surface 11 jointly enclose an accommodating space 10 for accommodating a container. The base 1 further includes an extension part 12 extending outward from the edge of the container bottom contact surface 11, and the container bottom contact surface 11 is provided with a through groove 13. The container holder 100 is provided with a base opening 15 extending from the edge of the extension part 12 to the side wall 2 in a curved manner, and the base opening 15 is communicated with the through groove 13. It can be appreciated that the through groove 13 penetrates in the horizontal direction of the container bottom contact surface 11, and it can be completely hollowed out in the vertical direction of the container bottom contact surface 11, or it can be a strip groove that is recessed downward from the container bottom contact surface 11.

Because the base opening 15 is communicated with the through groove 13, the container holder 100 can be fixed on the plane where the container holder 100 is placed by passing a rope through the base opening 15 to reach the through groove 13, and then fixing the rope on the plane where the container holder 100 is placed, for example the surface of a paddle, and the position of the container holder 100 can be adjusted along the rope on the plane.

Preferably, the highest point of the base opening 15 is higher than the container bottom contact surface 11, so that the rope is not likely to be separated from the through groove 13 and slip out of the base opening 15 during bumping, and the fixing effect of the container holder 100 is better.

Further, the base 1 further includes a support part 16 straddling below the through groove 13, and the support part 16 supports the rope accommodated in the through groove 13, so that the rope can be more stable in the through groove 13. In addition, the support part 16 is provided with a through hole 17, and the container holder 100 can also be fixed to the plane where the container holder 100 is placed by screws or bolts passing through the through hole 17. For example, if there is a prefabricated multifunctional interface on the plane, the through hole 17 is a hexagonal screw hole, and the container holder 100 can be fixed by fastening the screw by rotating the container holder 100 in cooperation with the external hexagonal screw.

In this embodiment, the sidewall 2 includes a lower sidewall 21 connected to the base 1 and an upper sidewall 22 extending upward from the lower sidewall 21. The diameter of the annulus surrounded by the upper sidewall 22 is larger than that of the annulus surrounded by the lower sidewall 21, so that beverage containers of different sizes can be placed in the container holder 100, which increases the flexibility of the container holder 100 when it is used.

Preferably, the container holder 100 is made of soft silica gel and is integrally injection molded, which is lightweight and more durable and sun-resistant. It can be appreciated that the container holder 100 may also be made of ABS (Acrylonitrile Butadiene Styrene) resin, which is harder than silica gel, and can also be integrally injection molded, which is convenient for manufacturing.

The container holder 100 provided by the present disclosure includes a base 1 with a container bottom contact surface 11 and a sidewall 2 extending upward from the edge of the container bottom contact surface 11. The sidewall 2 and the container bottom contact surface 11 jointly enclose an accommodating space 10 for accommodating a container. The base 1 further includes an extension part 12 extending outward from the edge of the container bottom contact surface 11, the container bottom contact surface 11 is provided with a through groove 13, and the container holder 100 is provided with a base opening 15 extending from the edge of the extension part 12 to the sidewall 2 in a curved manner. With the base opening 15 communicated with the through groove 13, the container holder 100 can be fixed on the plane where the container holder 100 is placed by the rope, and the position of the container holder 100 can be adjusted along the rope.

Figure 3:
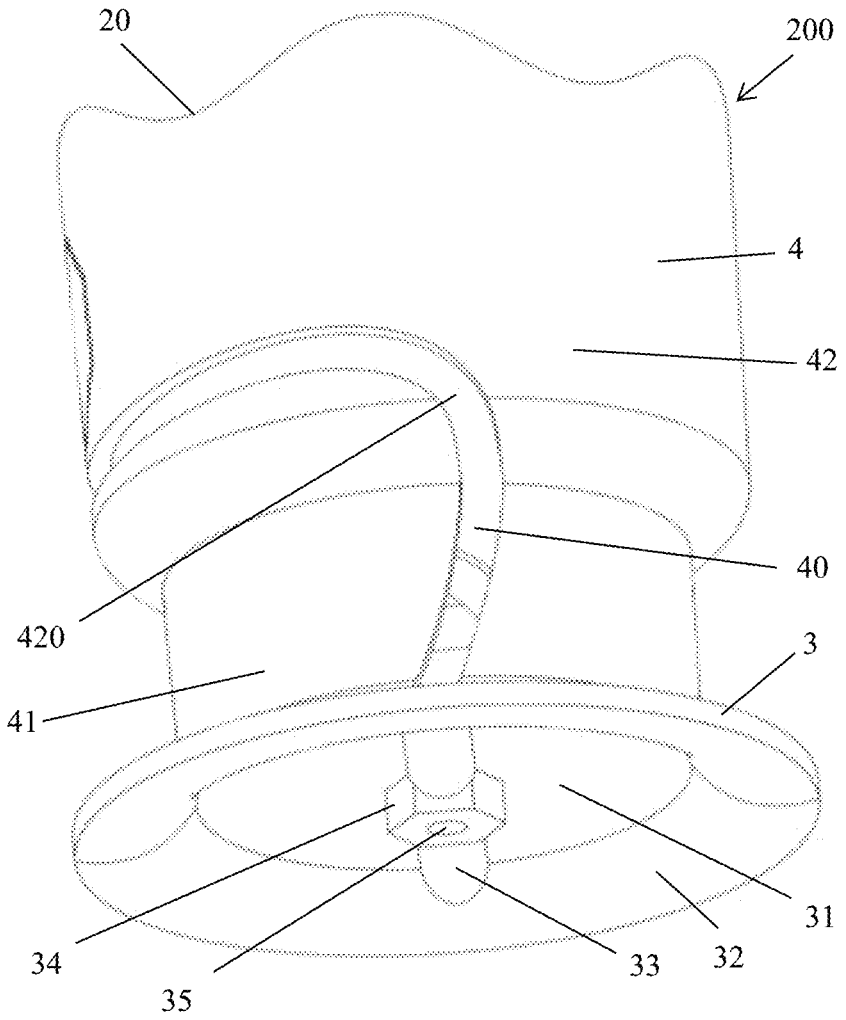
FIG. 3 is a combined schematic view of a container holder provided by another embodiment.

As shown in FIG. 3, the present disclosure further provides a container holder 200, which includes a base 3 with a container bottom contact surface 31 and a sidewall 4 extending upward from the edge of the container bottom contact surface 31. The sidewall 4 and the container bottom contact surface 31 jointly enclose an accommodating space 20 for accommodating a container. The base 3 further includes an extension part 32 extending outward from the edge of the container bottom contact surface 31, the container bottom contact surface 31 is provided with a through groove 33, and the container holder 200 is provided with a sidewall opening 40 extending from the outer surface of the sidewall 4 to the container bottom contact surface 31 in a curved manner. The sidewall opening 40 is communicated with the through groove 33.

In this embodiment, the sidewall 4 includes a lower sidewall 41 connected to the base 3 and an upper sidewall 42 extending upward from the lower sidewall 41. The diameter of the annulus surrounded by the upper sidewall 42 is larger than that of the annulus surrounded by the lower sidewall 41. The sidewall opening 40 includes an upper sidewall opening 420 provided in the upper sidewall 42, and the upper sidewall opening 420 penetrates the lower sidewall 41 and is communicated with the through groove 33.

Because the upper sidewall opening 420 is communicated with the through groove 33, the container holder 200 can be fixed on the plane where the container holder 200 is placed by passing a rope through the upper sidewall opening 420 to reach the through groove 33, and then fixing the rope on the plane where the container holder 200 is placed, for example the surface of a paddle, and the position of the container holder 200 on the plane can be adjusted along the rope.

Preferably, the base 3 further includes a support part 34 straddling below the through groove 33, and the support part 34 supports the rope accommodated in the through groove 33, so that the rope can be more stable in the through groove 33. In addition, the support part 34 is provided with a through hole 35, and the container holder 200 can also be fixed to the plane where the container holder 200 is placed by screws or bolts passing through the through hole 35.

Figure 4:
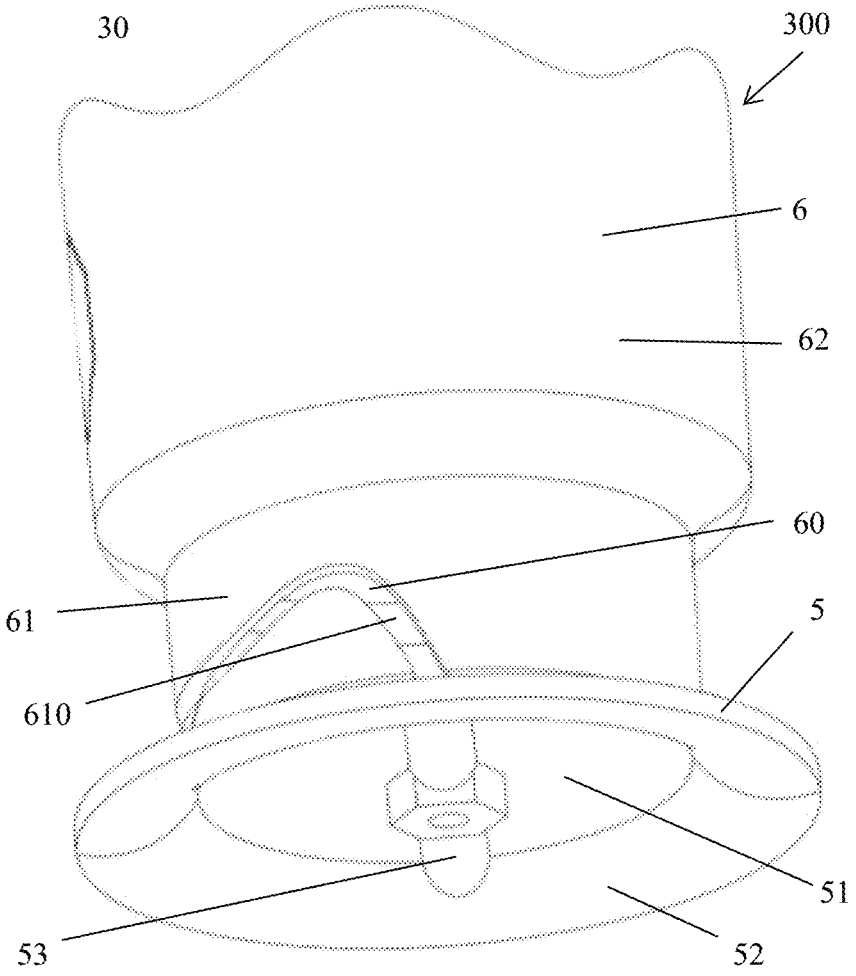
FIG. 4 is a combined schematic view of a container holder provided by still another embodiment.

As shown in FIG. 4, the present disclosure further provides another container holder 300, which includes a base 5 with a container bottom contact surface 51 and a sidewall 6 extending upward from the edge of the container bottom contact surface 51. The sidewall 6 and the container bottom contact surface 51 together enclose an accommodating space 30 for accommodating a container. The base 5 further includes an extension part 52 extending outward from the edge of the container bottom contact surface 51, which is provided with a through groove 53, and the container holder 300 is provided with a sidewall opening 60 extending from the outer surface of the sidewall 6 to the container bottom contact surface 51. The sidewall opening 60 is communicated with the through groove 53.

In this embodiment, the sidewall 6 includes a lower sidewall 61 connected to the base 5 and an upper sidewall 62 extending upward from the lower sidewall 61. The diameter of the annulus surrounded by the upper sidewall 62 is larger than that of the annulus surrounded by the lower sidewall 61. The sidewall opening 60 includes a lower sidewall opening 610 provided in the lower sidewall 61.

Because the lower sidewall opening 610 is communicated with the through groove 53, the container holder 300 can be fixed on the plane where the container holder 300 is placed by passing a rope through the lower sidewall opening 610 to reach the through groove 53, and then fixing the rope on the plane where the container holder 300 is placed, for example the surface of a paddle, and the position of the container holder 300 on the plane can be adjusted along the rope.

Preferably, the highest point of the lower sidewall opening 610 is higher than the container bottom contact surface 51, so that the rope is not likely to be separated from the through groove 53 and slip out of the lower sidewall opening 610 during bumping, and the fixing effect of the container holder 300 is better.

The container holder provided by the present disclosure includes a base with a container bottom contact surface and a sidewall extending upward from the edge of the container bottom contact surface. The sidewall and the container bottom contact surface together enclose an accommodating space for accommodating a container. The base further includes an extension part extending outward from the edge of the container bottom contact surface. The container holder is provided with a sidewall opening extending from the outer surface of the sidewall to the container bottom contact surface in a curved manner, and the sidewall opening is communicated with the through groove. With the opening of the sidewall communicating with the through groove, the container holder can be fixed on the plane where the container holder is placed by the rope, and the position of the container holder can be adjusted along the rope.

The above embodiments are only intended to illustrate, rather than to limit the technical solution of the present disclosure. Although the present disclosure has been described in detail with reference to the above-mentioned embodiments, those skilled in the art should appreciate that the technical solution recorded in the above-mentioned embodiments can still be modified, or some or all of its technical features may be equally substituted. These modifications or substitutions do not make the essence of the corresponding technical solution deviate from the scope of the technical solution of each embodiment of the present disclosure.

What is claimed is:

1. A container holder, comprising a base with a container bottom contact surface and a sidewall extending upward from an edge of the container bottom contact surface, wherein the sidewall and the container bottom contact surface jointly enclose an accommodating space for accommodating a container, wherein the base further comprises an extension part extending outward from the edge of the container bottom contact surface; the container bottom contact surface is provided with a through groove, the container holder is provided with a base opening extending from an edge of the extension part to the sidewall in a curved manner, and the base opening is communicated with the through groove.

2. The container holder according to claim 1, wherein a highest point of the base opening is higher than the container bottom contact surface.

3. The container holder according to claim 1, wherein the base further comprises a support part straddling below the through groove.

4. The container holder according to claim 3, wherein the support part is provided with a through hole.

5. The container holder according to claim 1, wherein the sidewall comprises a lower sidewall connected with the base and an upper sidewall extending upward from the lower sidewall, and a diameter of an annulus enclosed by the upper sidewall is larger than that of an annulus enclosed by the lower sidewall.

6. A container holder, comprising a base with a container bottom contact surface and a sidewall extending upward from an edge of the container bottom contact surface, wherein the sidewall and the container bottom contact surface jointly enclose an accommodating space for accommodating a container; wherein the base further comprises an extension part extending outward from the edge of the container bottom contact surface; the container bottom contact surface is provided with a through groove, the container holder is provided with a sidewall opening extending from an outer surface of the sidewall to the container bottom contact surface in a curved manner, and the sidewall opening is communicated with the through groove.

7. The container holder according to claim 6, wherein the sidewall comprises a lower sidewall connected with the base and an upper sidewall extending upward from the lower sidewall, and a diameter of an annulus enclosed by the upper sidewall is larger than that of an annulus enclosed by the lower sidewall.

8. The container holder according to claim 7, wherein the sidewall opening comprises an upper sidewall opening arranged on the upper sidewall, and the upper sidewall opening penetrates through the lower sidewall and is communicated with the through groove.

9. The container holder according to claim 7, wherein the sidewall opening comprises a lower sidewall opening arranged on the lower sidewall, and a highest point of the lower sidewall opening is higher than the container bottom contact surface.

10. The container holder according to claim 6, wherein the base further comprises a support part straddling below the through groove.

11. The container holder according to claim 10, wherein the support part is provided with a through hole.

* * * * *